US008950690B2

(12) United States Patent
Kraft

(10) Patent No.: US 8,950,690 B2
(45) Date of Patent: Feb. 10, 2015

(54) SAFETY DRAIN APPARATUS

(76) Inventor: Wayne Kraft, Littleton, CO (US)

( * ) Notice: Subject to any disclaimer, the term of this patent is extended or adjusted under 35 U.S.C. 154(b) by 1248 days.

(21) Appl. No.: 12/727,094

(22) Filed: Mar. 18, 2010

(65) Prior Publication Data

US 2010/0258202 A1 Oct. 14, 2010

Related U.S. Application Data

(60) Provisional application No. 61/202,606, filed on Mar. 18, 2009.

(51) Int. Cl.

| | |
|---|---|
| ***B05B 15/02*** | (2006.01) |
| ***F23D 11/34*** | (2006.01) |
| ***F23D 11/38*** | (2006.01) |
| ***E04H 4/12*** | (2006.01) |
| ***A61H 33/00*** | (2006.01) |
| ***E03C 1/22*** | (2006.01) |
| ***E03F 5/04*** | (2006.01) |

(52) U.S. Cl.

CPC ..... *E04H 4/1236* (2013.01); *A61H 33/6073* (2013.01); *E03C 1/22* (2013.01); *E03F 5/0402* (2013.01)

USPC ..... 239/106; 239/108; 239/104; 134/55; 134/111; 134/155; 4/507; 4/673; 137/240

(58) Field of Classification Search

USPC ..... 239/504, 18, 20, 104–106, 108, 109, 239/113; 4/673, 507; 134/55, 111, 155; 210/238

See application file for complete search history.

(56) References Cited

U.S. PATENT DOCUMENTS

| | | | | |
|---|---|---|---|---|
| 1,776,455 | A * | 9/1930 | Thompson | 239/521 |
| 3,522,814 | A * | 8/1970 | Olson | 134/111 |
| 5,388,601 | A * | 2/1995 | Mansur | 134/56 R |
| 6,029,912 | A | 2/2000 | Woolley | |
| 6,102,306 | A * | 8/2000 | Ask et al. | 239/201 |
| 6,182,767 | B1 * | 2/2001 | Jackson | 169/16 |
| 6,955,304 | B2 * | 10/2005 | Beach et al. | 239/1 |
| 2008/0098504 | A1 | 5/2008 | Knox et al. | |
| 2008/0190466 | A1 | 8/2008 | Gaus | |
| 2008/0251604 | A1 | 10/2008 | Schmid | |

FOREIGN PATENT DOCUMENTS

JP 2000-110219 4/2000

OTHER PUBLICATIONS

International Search Report and Written Opinion of the International Searching Authority issued in International Patent Application No. PCT/US2010/027834, mailed Nov. 1, 2010.

Photographs of water fountain and drain and line drawings thereof.

* cited by examiner

*Primary Examiner* — Dinh Q Nguyen

(74) *Attorney, Agent, or Firm* — Miles & Stockbridge P.C.; Michael A. Messina

(57) ABSTRACT

An anti entrapment fail safe drain having a drain cover for partially covering an influent opening; a pressurized supply line; and a nozzle assembly in communication with the pressurized supply line and mounted within a drain sump. The nozzle assembly is for directing a pressurized liquid in a pattern over a surface of the drain cover when the drain cover and the nozzle are immersed in the liquid such that a portion of the liquid above the pattern or objects suspended in standing liquid can not be pulled directly toward the drain cover through a drain inlet opening. The drain also has an effluent opening for connecting to the drain sump arranged such that the liquid flows into a pipe in a first direction. The pressurized supply line is arranged inside the pipe for returning the liquid to the nozzle assembly in a second direction opposite the first direction.

13 Claims, 9 Drawing Sheets

SAFETY DRAIN APPARATUS

CROSS REFERENCE TO PROVISIONAL APPLICATION

This application is based upon and claims the benefit of priority from U.S. Patent Application PCT/US2010/027834 filed on Mar. 18, 2010 and Provisional U.S. Patent Application 61/202,606 filed on Mar. 18, 2009, the entire contents of which are incorporated by reference herein.

TECHNICAL FIELD

The present disclosure relates to safety drains. The present disclosure has particular applicability to safety drains for swimming pools, fountains, hot tubs, etc. for providing a failsafe entrapment environment.

BACKGROUND

Main drains are a common feature in most water features such as pools, spas, fountains, artificial streams, rivers, ponds, etc. The drain is typically located in the bottom lowest portion of the body or sump that contains the fluid, which in most cases is water.

Such a drain is designed to allow the body of water to be pumped or gravity drained dry, if and when service is required. It is also used to remove fluid from the vessel and transport this fluid to another location for filtering or other uses. In some cases the main drain line is directly connected to the pump suction. In other cases the fluid is transported by natural differential pressure created by a difference in the fluid elevation similar to the way a garden hose is used to drain small pools or bodies of water. In general, all main drains are designed to evacuate the water or fluid from the fluid container. These drains consist of three major parts:

1. The sump which is the water tight housing that makes up the body of the drain.
2. The grating or cover which has a certain amount of open area allowing the water to pass through it into the sump. The function of the grating is to keep large debris from getting caught down in the drain and or plugging up the conduit connected to the drain by the third component called the face piping.
3. The face piping usually consists of a nipple or nipple and flange on larger diameter pipe. Under certain conditions a human body can get caught on the drain and drown.

SUMMARY

To overcome the disadvantages discussed above, the present application is directed to a safety drain that allows for prevention of accidental drowning from being unable to escape from suction of operation of a drain.

The drain according to the present disclosure works similarly to a conventional drain in regard to its general function of removing fluid from a container. However, the present safety drain has a pressurized supply line that brings pressurized liquid from a pump that the drain is supplying back to a centrally located internal distribution fixture at the main drain sump. The internal distribution fixture directs the liquid in a useful direction over the drain cover at an accelerated rate. This generally flat curtain of liquid directly above the drain cover creates a rip tide effect in the entire drain area. The outwardly and upwardly flowing current has significantly increased velocity because it is introduced via a nozzle assembly connected to the rip tide conduit (which returns water directly from the pump that the drain is supplying).

The present safety drain provides significant benefits and features over conventional drains. Its main purpose is eliminating the possibility of human entrapment by introducing a positive current directly above the negative suction current created by the drain effluent piping. The present safety drain pressure return assembly is connected directly to the pump discharge piping without any method of shut off. Thus, if the pump is running, then the liquid rip tide nozzle is delivering liquid above the cover of the drain, so entrapment is impossible. If the pump is shut down, there is no suction on the main drain, so entrapment can not occur.

Due to the rip tide current effect created by the unique design, there is an undertow effect that helps move the water to the small opening between the finished floor surface and bottom edge of the drain. This space is created by the installation feet used to secure the drain to the floor of the container. Furthermore, the continuous current shooting out from the center of the safety drain will push any large floating objects that could cover the entire cover away from the cover with a constant force, which eliminates the possibility of substantial open area coverage.

In addition, the disclosed safety drain can be installed without draining the pool or container of liquid, and the disclosed drain is far less intrusive than many other options in practice or discussed.

One embodiment of the present disclosure is directed to an anti entrapment fail safe drain comprising a drain cover for partially covering an influent opening; a pressurized supply line; and a nozzle assembly in communication with the pressurized supply line and mounted within a drain sump. The nozzle assembly is for directing a pressurized liquid in a pattern over a surface of the drain cover when the drain cover and the nozzle are immersed in the liquid such that a portion of the liquid above the pattern or objects suspended in standing liquid can not be pulled directly toward the drain cover through an influent opening.

In another embodiment, the safety drain further comprises at least one effluent opening for connecting to the drain sump. The influent opening and effluent opening are arranged such that the liquid flows into a pipe in a first direction from the influent opening towards the effluent opening. The pressurized supply line has an outer diameter smaller than an inner diameter of the pipe. Optionally, the pressurized supply line is arranged inside the pipe for returning the liquid to the nozzle assembly in a second direction opposite the first direction.

Additional advantages and other features of the present disclosure will be set forth in part in the description which follows and in part will become apparent to those having ordinary skill in the art upon examination of the following or may be learned from the practice of the disclosure. The advantages of the disclosure may be realized and obtained as particularly pointed out in the appended claims.

As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION

A safety drain of the present disclosure will now be described with reference to the drawings.

Figure 1:
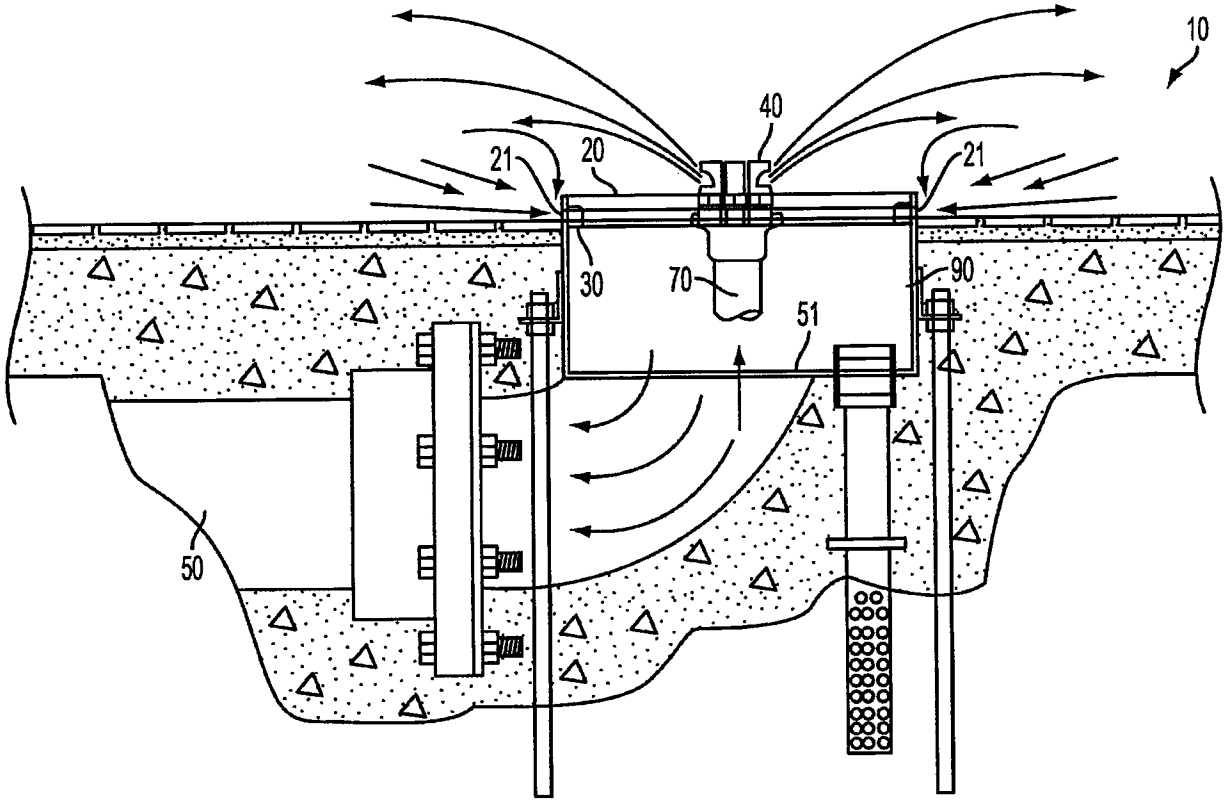
FIG. 1 is a side view of a safety drain according to an embodiment of the present disclosure.

As shown in FIG. 1, a safety drain 10 for a vessel comprises a drain cover 20 for partially covering an influent opening 30. The drain cover 20 has a plurality of openings 21 for allowing the liquid to pass to the influent opening 30, the plurality of openings 21 spaced apart such that the flow of liquid into the openings 21 will not be concentrated at only one opening. The safety drain 10 also has a pressurized supply line 70, and a nozzle assembly 40 in communication with the pressurized supply line 70 and mounted within a drain sump 90. The nozzle assembly 40 is for directing a pressurized liquid in a pattern represented by the lines emanating from the nozzle 40 over a surface of the drain cover 20 when the drain cover 20 and the nozzle assembly 40 are immersed in the liquid such that a portion of the liquid above the pattern or objects suspended in standing liquid can not be pulled directly toward the drain cover 20 through a drain cover opening 21.

The safety drain 10 additionally has at least one effluent opening 51 for connecting to the drain sump 90; wherein the influent opening 30 and effluent opening 51 are arranged such that the liquid flows into a pipe 50 in a first direction from the influent opening 30 towards the effluent opening 51. The pressurized supply line 70 has an outer diameter smaller than an inner diameter of the pipe 50. This allows for the pressurized supply line 70 is arranged inside the pipe 50 for returning the liquid to the nozzle assembly 40 in a second direction opposite the first direction. The pressurized supply line 70 must have continuous and uninterrupted flow from downstream of the pump to the nozzle assembly 40.

Figure 2:
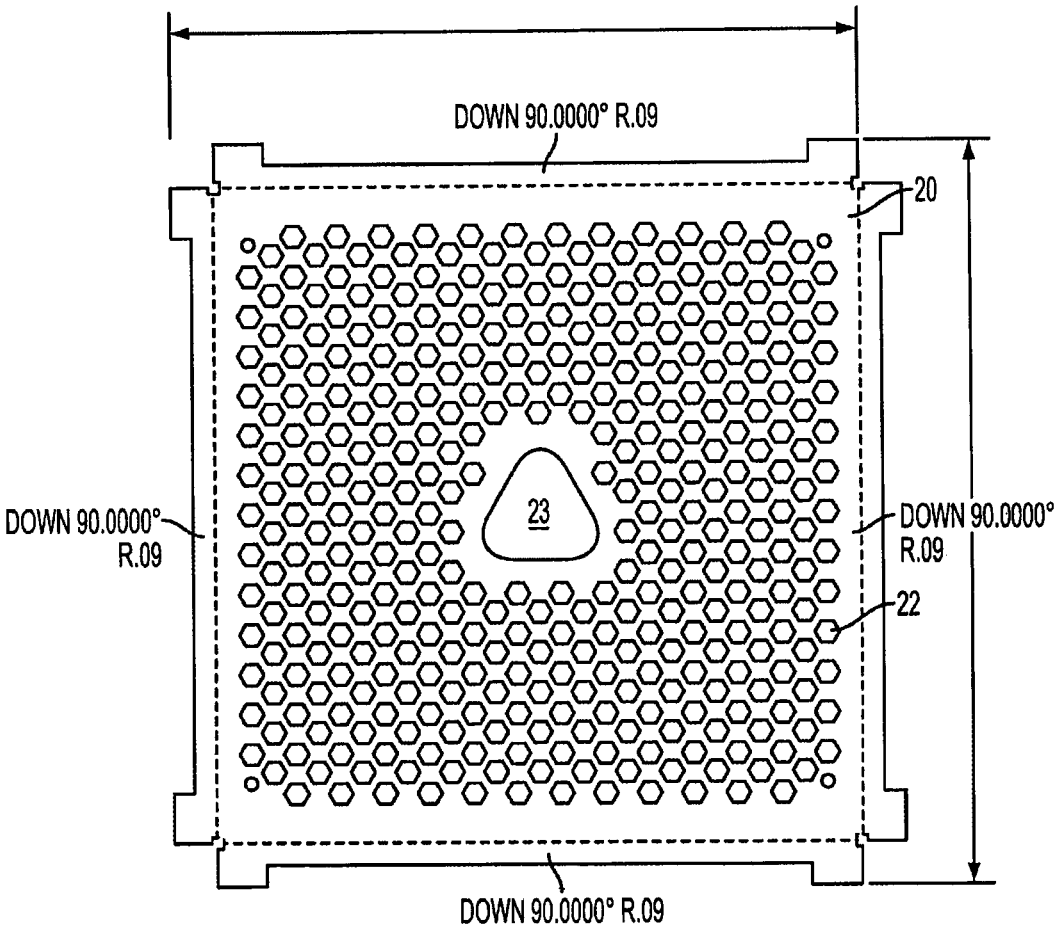
FIG. 2 is a flattened top view of the drain cover according to FIG. 1.

FIG. 2 shows a flattened top view of the drain cover 20. In this embodiment, the drain cover has a square shaped top. Other embodiments may include round tops, triangular tops or any shape suitable for the respective use. The drain cover 20 has a series of holes 22 through the surface of the drain cover 20 to allow for addition liquid to enter the drain sump 90 via the influent opening 30. The drain cover 20 also has an opening 23 for the nozzle assembly 40 (see, FIG. 1). In the embodiment shown, the opening 23 is triangular, however, the opening 23 may be of any suitable shape necessary to allow for the nozzle to protrude.

Figure 3A:
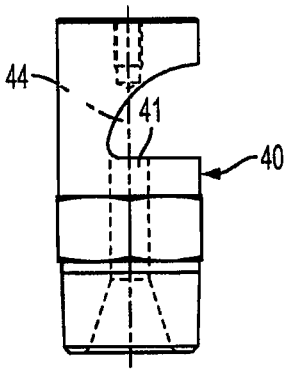
FIGS. 3A-B are views of a nozzle used in the embodiment of FIG. 1.
Figure 3B:
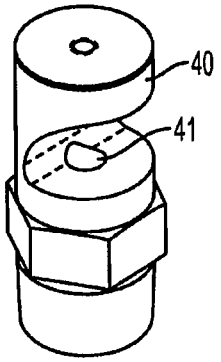

FIGS. 3A-B show one embodiment of a nozzle assembly 40. In this embodiment, the nozzle assembly has a curved cut out section 44 for dispersing the liquid therefrom. The liquid emanates from an opening 41 such that the liquid hits the upper surface of the curved cut out section 44. The curved surface causes the liquid to fan out in a pattern in order to cover an area of the drain cover 20 (see FIG. 1). The nozzle assembly 40 is additionally shaped for distributing the liquid over substantially the entire surface of the drain cover 20.

Figure 4A:
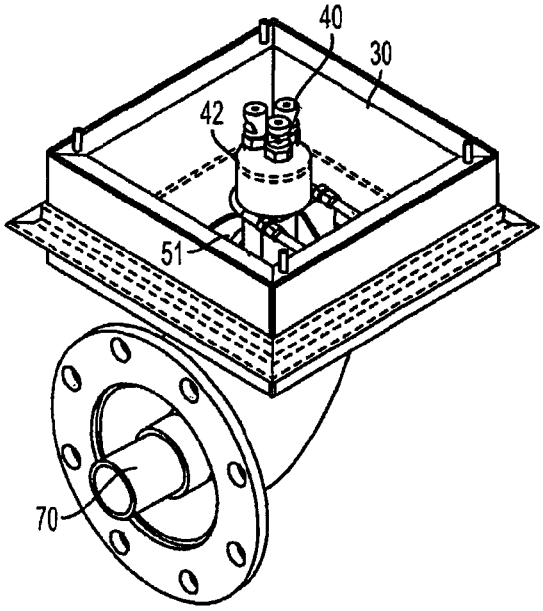
FIGS. 4A-B are perspective views of the safety drain according to FIG. 1.
Figure 4B:
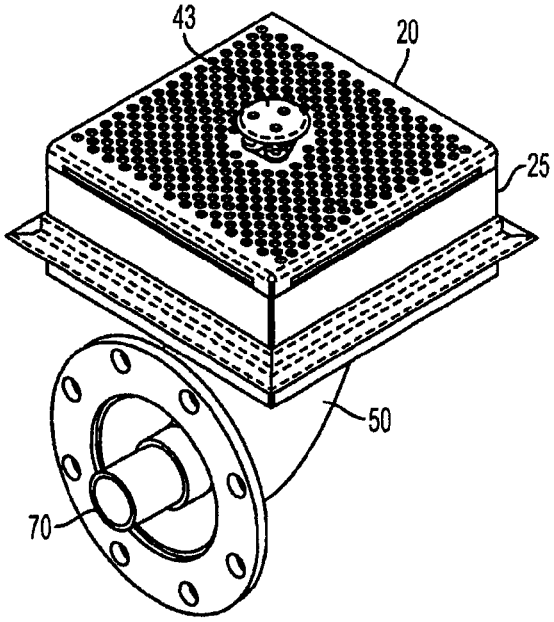

FIGS. 4A-B show a perspective view of the safety drain 10. As is shown, pipe 50 has an effluent opening 51 in communication with the influent opening 30, and the effluent opening 51 and influent opening 30 are arranged such that a liquid flows in the pipe 50 in a first direction from the influent opening 30 towards the effluent opening 51.

Figure 5:
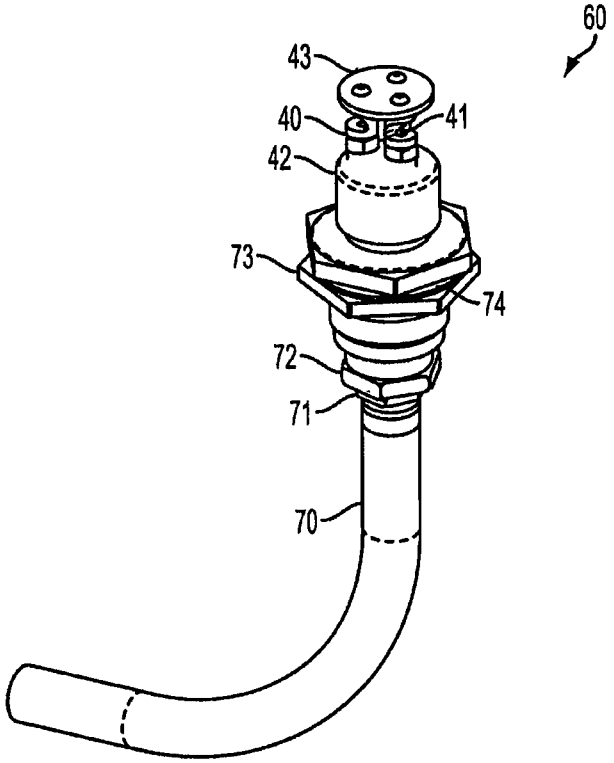
FIG. 5 is a perspective view of the pressure return assembly according to another embodiment of the present disclosure.

FIG. 5 is a representation of a pressure return assembly 60. The pressure return assembly 60 comprises a pressurized supply line 70 having an outer diameter smaller than an inner diameter of the pipe 50 (see FIG. 4A). The pressurized supply line 70 is arranged inside the pipe 50 for returning the liquid to the nozzle assembly 40 in a second direction opposite the first direction. In this embodiment, the pressurized supply line 70 is connected to the nozzle assembly 40 via a pipe to tube adaptor 71 and reducer bushing 72, and two bulkheads 73 separated by a washer 74. The topmost bulkhead 73 connects to the nozzle assembly 40 via the nozzle head 42. The nozzle assembly 40 has a nozzle cap 43 on it.

Figure 6:
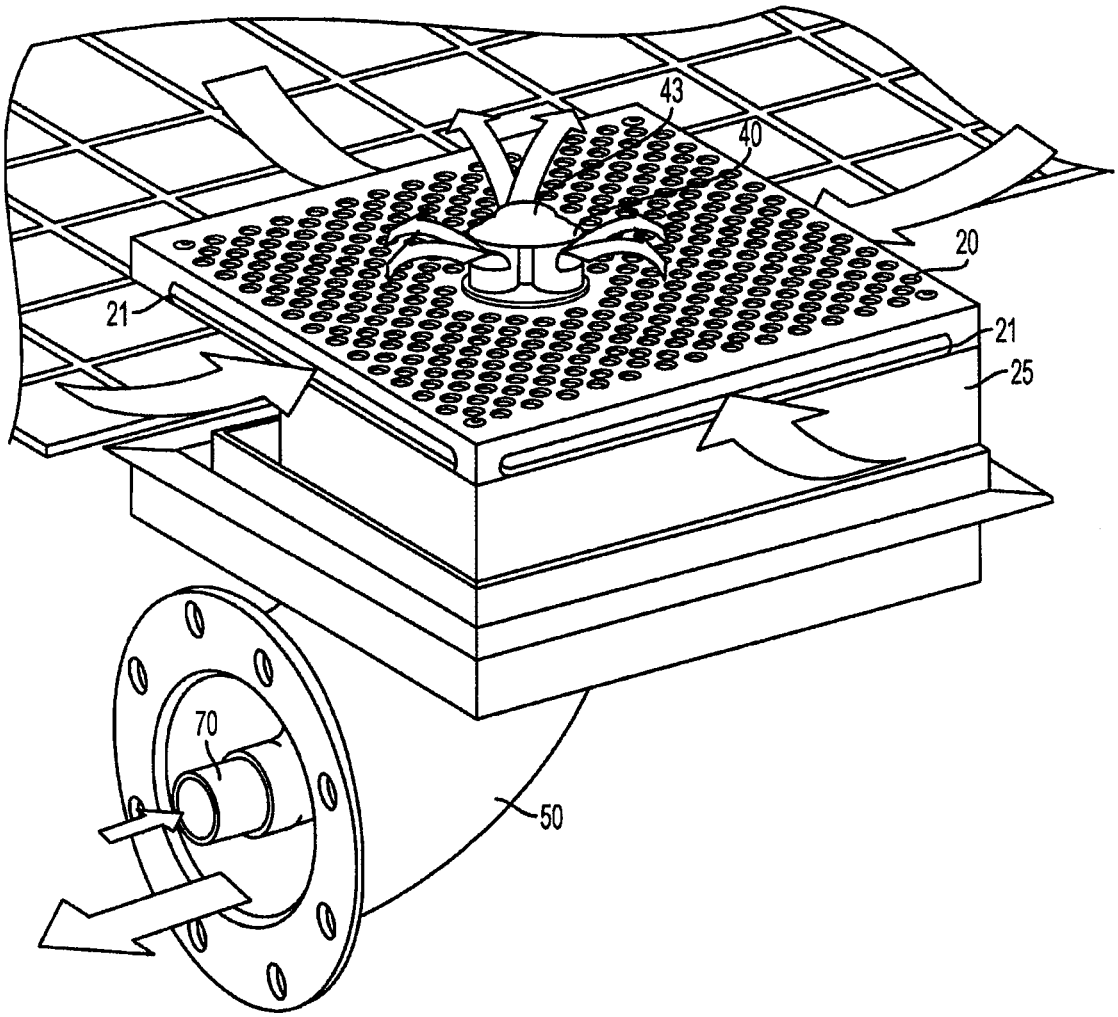
FIG. 6 is a perspective view of a safety drain according to another embodiment of the present disclosure.
Figure 7:
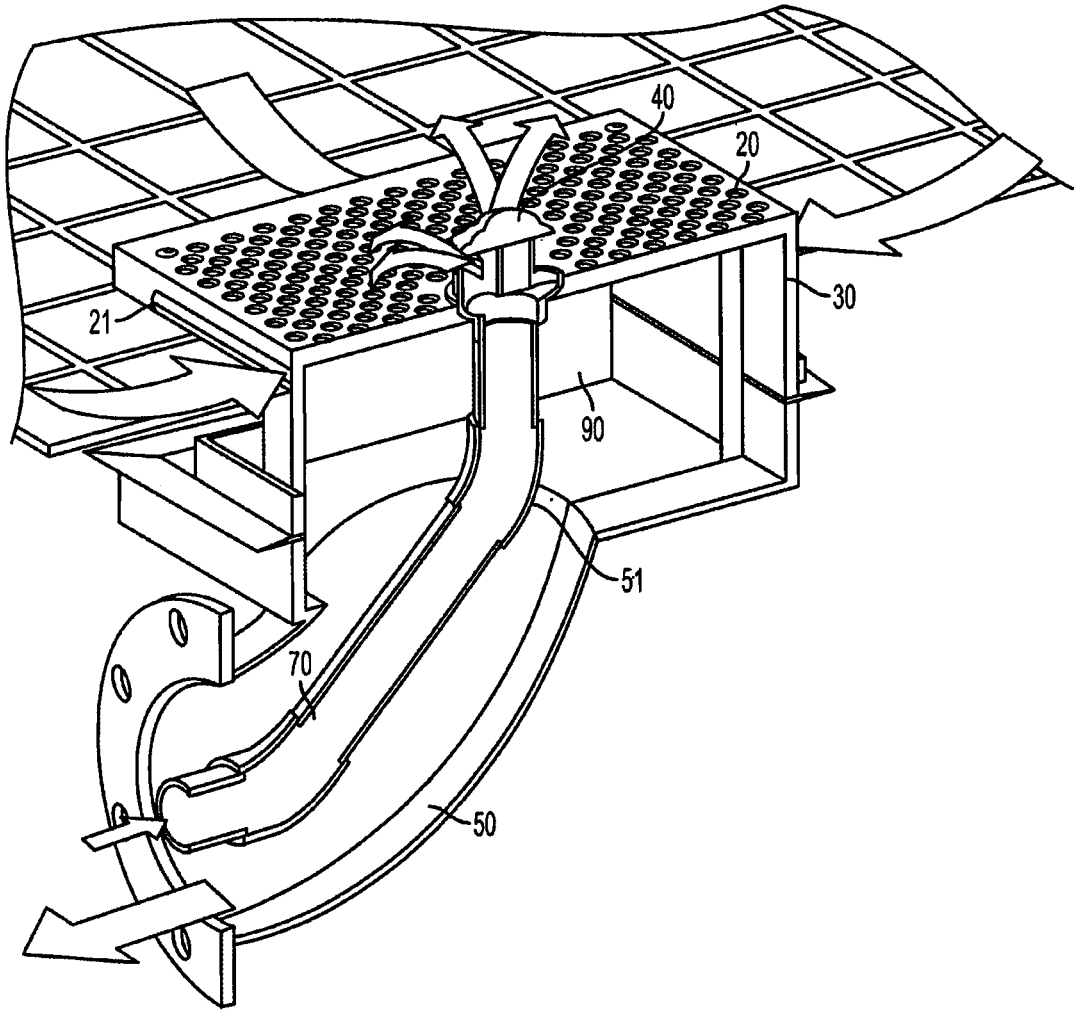
FIG. 7 is a cutaway perspective view of the safety drain according to FIG. 6.

FIGS. 6 and 7 shows the flow of liquid during operation of the safety drain 10. In this embodiment, liquid flows from a drain cover opening 21 located in a side wall 25 of the drain cover 20 into the effluent opening 51 via the influent opening 30. While in operation, the safety drain 10 distributes a pressurized liquid out from the nozzle assembly 40 which has a velocity that is greater than a velocity of the liquid flowing into the influent opening 30. This is due to the heightened pressure brought about by the smaller size of the pressurized supply line 70 and nozzle assembly 40 as compared to the pipe 50 and drain cover opening 21.

In another embodiment of the present disclosure, a liquid cycling system comprising a pump for circulating a liquid is used to circulate the liquid through the nozzle assembly 40. The conventional pump (not shown) cycles the liquid through the pipe 50 and the pressurized supply line 70 such that upon deactivating the pump, the circulation is stopped in both the pipe 50 and the pressurized supply line 70.

Figure 8A:
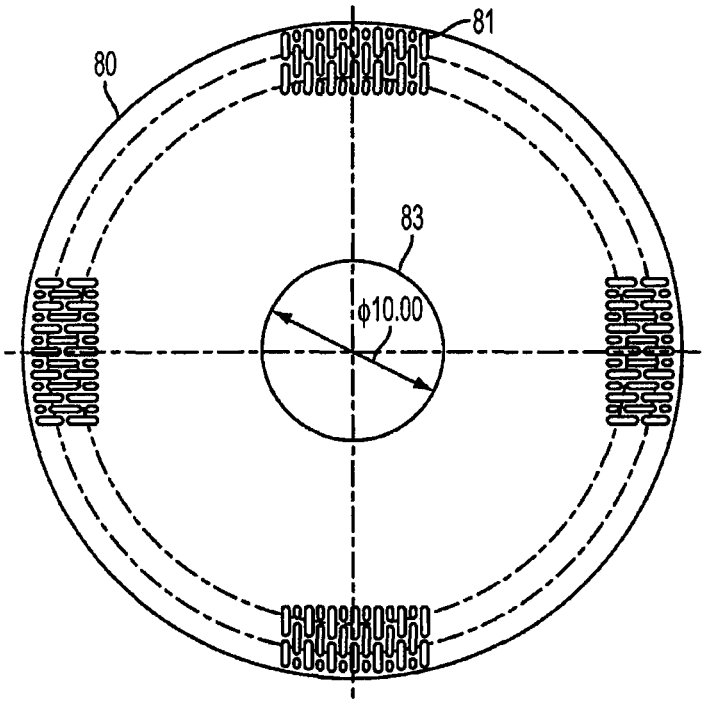
FIGS. 8A-B are top and side views of a drain cover of a safety drain according to another embodiment of the present disclosure.
Figure 8B:
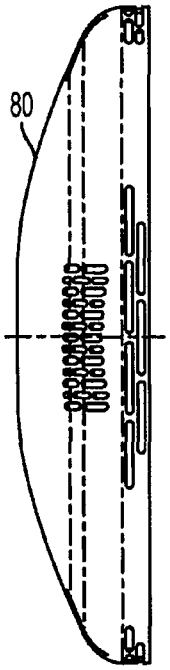

In another embodiment of the safety drain of the present disclosure, the drain cover 20 has a substantially curved shape. FIGS. 8A-B show the drain cover 80 has a circular perimeter shape and the top surface is curved. The drain cover has a plurality of openings 81. The plurality of openings 81 should be placed apart from each other to prevent concentration of the suctioned liquid at only one opening 81. The drain cover 80 also has an opening 83 for a nozzle assembly, such as previously described nozzle assembly 40.

Figure 9:
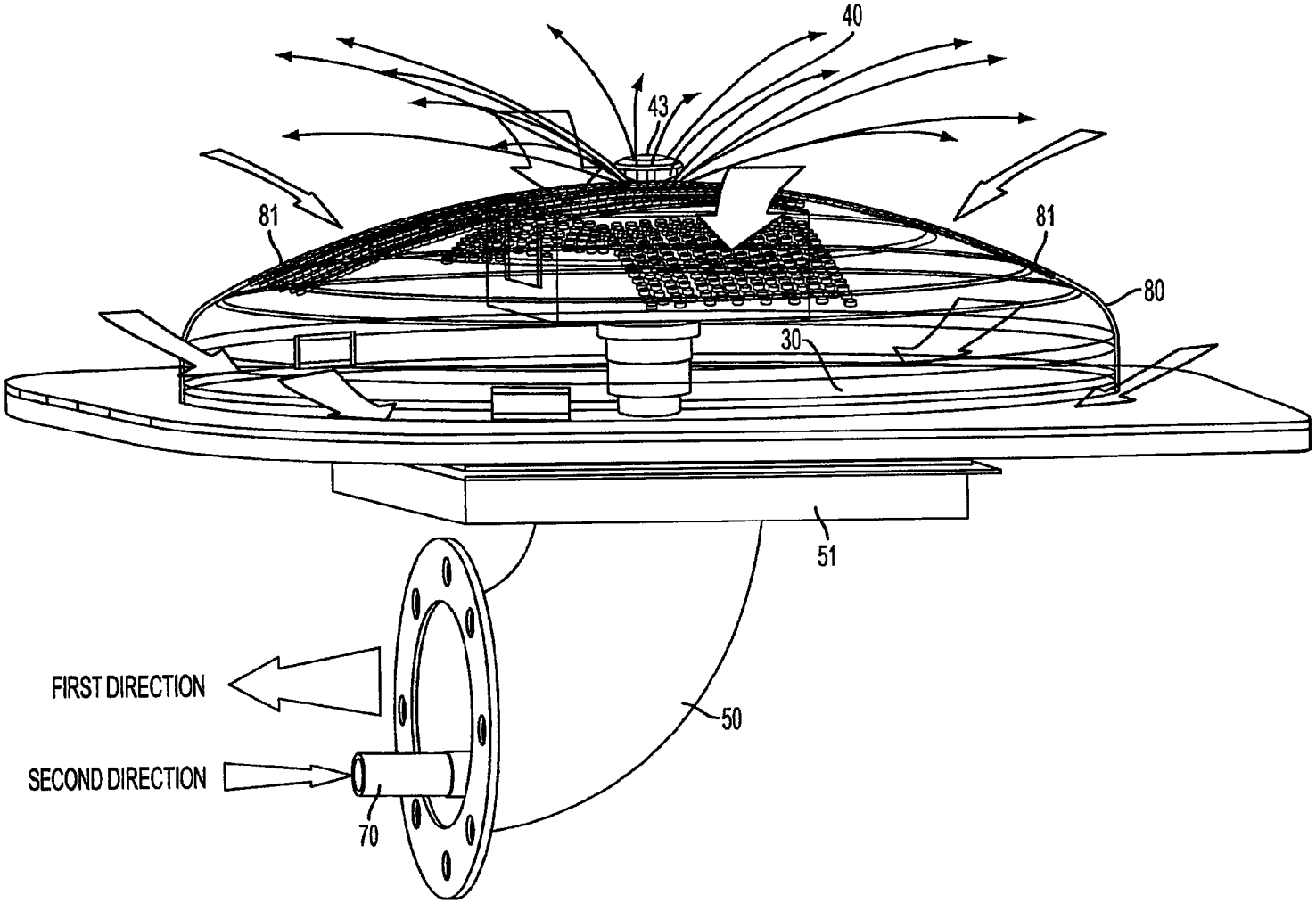
FIG. 9 is a side view of a safety drain according to FIG. 8.

FIG. 9 is a representation of liquid flow during operation of the safety drain having a curved drain cover 80. As can be seen, the liquid flows into the plurality of openings 81 and is passed through the influent opening 30 and through the pipe 50 in a direction toward the effluent opening 51. The pressure return assembly 60 returns the liquid to the nozzle 40 via the pressurized supply line 70. The velocity of the liquid discharged from the nozzle is greater than the velocity of the liquid going into the influent opening 30.

The location and size of these openings 81 will meet all the requirements stipulated by local law and national law, for example the Virginia Graeme Baker Pool and Spa Safety Act (VGB). One significant feature of the present disclosure is that it meets all the criteria set forth by the VGB act where only one main drain exists. Installing the safety drain 80 of the present disclosure over the single existing drain resolves the issue of having two main drains required to comply with the VGB act.

The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the present disclosure can be practiced without resorting to the details specifically set forth. In other instances, well known processing structures have not been described in detail, in order not to unnecessarily obscure the present disclosure.

Only a few examples of the present disclosure are shown and described herein. It is to be understood that the disclosure is capable of use in various other combinations and environments and is capable of changes or modifications within the scope of the inventive concepts as expressed herein.

What is claimed is:

1. An anti-entrapment fail safe drain comprising:

a drain sump with an influent opening;

a drain cover for partially covering the influent opening of the drain sump, the drain cover having openings and a top surface;

a pressurized supply line; and a nozzle assembly in fluid communication with the pressurized supply line and mounted within the drain sump such that a portion of the nozzle assembly extends through the drain cover and protrudes above the top surface of the drain cover;

wherein the nozzle assembly is for directing a pressurized liquid in a pattern over a surface of the drain cover when the drain cover and the nozzle are immersed in the liquid, such that a portion of the liquid above the pattern or objects suspended in standing liquid can not be pulled directly toward the drain cover through a drain cover opening.

2. The drain of claim 1, further comprising at least one effluent opening for connecting to the drain sump;

wherein the influent opening and effluent opening are arranged such that the liquid flows into a pipe in a first direction from the influent opening towards the effluent opening; and wherein the pressurized supply line has an outer diameter smaller than an inner diameter of the pipe, and the pressurized supply line is arranged inside the pipe for returning the liquid to the nozzle assembly in a second direction opposite the first direction.

3. The drain of claim 2, wherein said pressurized liquid has a velocity that is greater than a velocity of the liquid flowing in the first direction.

4. The drain of claim 1, wherein the pressurized liquid has a velocity that is greater than a velocity of the liquid flowing into the drain cover openings.

5. The drain of claim 1, wherein the nozzle assembly is shaped for distributing the liquid over substantially the entire outer surface of the drain cover.

6. The drain of claim 1, wherein the drain cover has a plurality of openings for allowing the liquid to pass to the influent opening, the plurality of openings spaced apart such that the flow of liquid into the plurality openings will not be concentrated at only one opening.

7. The drain of claim 6, wherein the drain cover has a substantially flat surface and at least two side walls having a side opening for allowing the liquid to pass to the influent opening.

8. The drain of claim 6, wherein the drain cover has a substantially curved shape.

9. An anti-entrapment fail safe drain comprising:

a drain sump with an influent opening;

a drain cover for partially covering the influent opening of the drain sump, the drain cover having openings;

a pressurized supply line; and a nozzle assembly in fluid communication with the pressurized supply line and mounted within the drain sump such that a portion of the nozzle assembly extends through the drain cover;

wherein the nozzle assembly is for directing a pressurized liquid in a pattern over a surface of the drain cover when the drain cover and the nozzle are immersed in the liquid, such that a portion of the liquid above the pattern or objects suspended in standing liquid cannot be pulled directly toward the drain cover through the drain cover openings.

10. The drain of claim 9, further comprising at least one effluent opening for connecting to the drain sump;

wherein the influent opening and effluent opening are arranged such that the liquid flows into a pipe in a first direction from the influent opening towards the effluent opening; and wherein the pressurized supply line has an outer diameter smaller than an inner diameter of the pipe, and the pressurized supply line is arranged inside the pipe for returning the liquid to the nozzle assembly in a second direction opposite the first direction.

11. The drain of claim 10, wherein said pressurized liquid has a velocity that is greater than a velocity of the liquid flowing in the first direction.

12. The drain of claim 9, wherein the pressurized liquid has a velocity that is greater than a velocity of the liquid flowing into the drain cover openings.

13. The drain of claim 9, wherein the nozzle assembly is shaped for distributing the liquid over substantially the entire outer surface of the drain cover.

* * * * *